United States Patent [19]

Lewis

[11] 4,286,955

[45] Sep. 1, 1981

[54] FIBER SHRINKING COMPOSITION FOR NYLON PILE FABRIC

[75] Inventor: Robert D. Lewis, Landisville, Pa.

[73] Assignee: Armstrong Cork Company, Pa.

[21] Appl. No.: 62,317

[22] Filed: Jul. 30, 1979

[51] Int. Cl.[3] ..... D06P 3/24; B05D 5/00

[52] U.S. Cl. ..... 8/115.6; 8/466; 8/478; 8/492; 8/594; 8/611; 8/929; 9/DIG. 21; 26/18.5; 106/206; 106/243; 106/286.6; 252/8.8

[58] Field of Search ..... 106/206, 286.6, 243; 252/8.8 AK; 8/62, 66, 115.6, DIG. 21, 466, 478

[56] References Cited

U.S. PATENT DOCUMENTS

| | | | |
|---|---|---|---|
| 3,849,159 | 11/1974 | Palmer et al. | 8/17 |
| 4,129,416 | 12/1978 | Bennett et al. | 8/115 |
| 4,192,647 | 3/1980 | Kuryla et al. | 8/62 |

*Primary Examiner*—Theodore E. Pertilla

*Attorney, Agent, or Firm*—Dennis M. Kozak; Daniel De Joseph

[57] ABSTRACT

An aqueous-based nylon fiber shrinking composition which can be formulated into a print paste is disclosed. The resulting print paste exhibits excellent viscosity stability and can be applied to nylon pile fabric to produce print-embossed pattern fabric.

9 Claims, No Drawings

FIBER SHRINKING COMPOSITION FOR NYLON PILE FABRIC

This invention relates to an aqueous-based nylon fiber shrinking composition.

In one of its more specific aspects, this invention pertains to a dye-compatible, aqueous-based nylon fiber shrinking composition which can be formulated into a print paste. The paste exhibits excellent viscosity stability and can be employed to shrink and print predetermined areas of a nylon pile fabric. The resulting nylon pile fabric structure, having printed shrunken pile areas, is generally described in the floor covering art as a print-embossed patterned fabric.

The chemical shrinking of nylon fibers for the purpose of producing embossed effects in nylon pile fabric is well known. When shrinking nylon pile fabric, it is desirable that the shrinking composition be incorporated into a print paste which will act to dye as well as shrink the pile fabric. This is particularly true where the pile fabric is carpeting.

The aqueous-based nylon fiber shrinking composition of the present invention is particularly suitable for use as a print paste inasmuch as it facilitates the use of all standard printing acid and disperse dyes. Furthermore, the resulting print paste possesses excellent viscosity stability making it particularly suitable for use under carpet production conditions.

According to this invention, there is provided an aqueous-based nylon fiber shrinking composition comprising calcium nitrate; benzyl alcohol; a polyhydric alcohol or an oxy derivative of a polyhydric alcohol; a urea compound selected from the group consisting of urea, thiourea and 1,3-dimethylurea; and, at least one carboxylic acid selected from the group consisting of formic acid, acetic, propionic, butyric, oxalic, malonic, glutaric, maleic, glycolic, lactic, glyceric, malic, tartaric and citric.

Also, according to this invention, there is provided a print paste composition comprising (a) an effective amount of an aqueous-based nylon fiber shrinking composition comprising calcium nitrate; benzyl alcohol; a polyhydric alcohol or an oxy derivative of a polyhydric alcohol; a urea compound selected from the group consisting of urea, thiourea and 1,3-dimethylurea; and, at least one carboxylic acid selected from the group consisting of formic, acetic, propionic, butyric, oxalic, malonic, glutaric, maleic, glycolic, lactic, glyceric, malic, tartaric and citric; (b) a dye; and (c) a thickening agent.

In one preferred embodiment of this invention, the aqueous-based nylon fiber shrinking composition consists essentially of calcium nitrate, benzyl alcohol, propanediol, 1,3-dimethylurea, formic acid and lactic acid.

In another preferred embodiment, the aqueous based nylon fiber shrinking composition consists essentially of calcium nitrate, benzyl alcohol, propanediol, 1,3-dimethylurea, formic acid, lactic acid and glycolic acid.

As used herein, the term "nylon pile fabric" is intended to refer to and include upholstery fabric and pile carpeting, produced using fibers of nylon 66, nylon 6, or mixtures thereof.

The ingredients in the aqueous-based nylon fiber shrinking composition can be employed in the following quantities:

| Composition | Composition Weight Percent Range |
|---|---|
| calcium nitrate | 5–50 |
| benzyl alcohol | 5–20 |
| polyhydric alcohol or oxy derivative thereof | 2.5–15 |
| urea compound | 1–10 |
| carboxylic acid | 5–45 |
| water | Balance |

The polyhydric alcohol or its oxy derivatives serve as a co-solvent for both the benzyl alcohol and the aqueous phases of the nylon fiber shrinking composition. Accordingly, use can be made of any polyhydric alcohol or oxy derivatives thereof provided it is soluble in both phases of the composition. The use of such a co-solvent serves to eliminate the benzyl alcohol-aqueous interface and provides a nylon fiber shrinking composition having substantially a single continuous phase.

Representative examples of the above usable polyhydric alcohols and their oxy derivatives are: 1,2-ethanediol; 1,2-propanediol; 1,3-propanediol; 1,2-butanediol; 1,5-pentanediol; 1,6-hexanediol; 1,9-nonanediol; 1,2,3-propanetriol; 2,2'-oxydiethanol; 2,2'-oxydipropanol; 1,2,3-propanetriol and the like and mixtures thereof.

In one embodiment of the invention, the aqueous-based nylon fiber shrinking composition suitable for use to shrink nylon 66 pile fabric will consist essentially of about 32.5 weight percent calcium nitrate, about 7.5 weight percent benzyl alcohol, about 7.5 weight percent propanediol, about 2 weight percent 1,3-dimethylurea, about 10 weight percent formic acid, about 10 weight percent lactic acid, and about 5 weight percent glycolic acid, the balance of the composition being water.

In one embodiment of this invention, the aqueous-based nylon fiber shrinking composition suitable for use to shrink nylon 6 pile fabric will consist essentially of about 15 weight percent calcium nitrate, about 5 weight percent benzyl alcohol, about 5 weight percent propanediol, about 1 weight percent 1,3-dimethylurea, about 10 weight percent formic acid and about 10 weight percent lactic acid, the balance of the composition being water.

The ingredients added to the aqueous-based nylon fiber shrinking composition to proudce a print paste composition of this invention can be employed in the following quantities:

| Ingredient | Parts per 100 parts of the Shrinking Composition Range |
|---|---|
| dye(s) | 0.1–2 |
| thickening agent | 0.5–5 |

The print paste composition can contain any standard production printing acid dye or disperse dye or combination of dyes including anthraquinone, azo, monazo, quinoline, diazo dye types and the like.

The print paste composition can contain any conventional print paste thickening agent which will thicken and hold its viscosity at print paste pHs less than 2.

One particularly suitable thickening agent is designated "Natrosol 250 HHX" commercially available from Hercules Inc.

Natrosol 250 HHX is a hydroxyethyl cellulose gum.

The nylon fiber shrinking composition and the print paste composition can be applied to nylon pile fabric in any suitable manner such as screen printing followed by treating with saturated steam at 100° C., water washing and drying as taught in U.S. Pat. No. 4,129,416 herein incorporated by reference.

The following examples demonstrate the preparation of the aqueous-based nylon fiber shrinking composition and the print paste composition of this invention.

EXAMPLE I

This mixing procedure is based upon the preparation of 100 kilograms of the nylon fiber shrinking composition. All water is deionized.

Into a main mix tank, introduce about 25.5 kilograms of water, about 25 kilograms of formic acid with stirring.

Introduce about 2 kilograms of 1,3-dimethylurea into the contents of the main mix tank with stirring.

Introduce about 7.5 kilograms of 1,2-propanediol into the contents of the mix tank with stirring.

Introduce about 7.5 kilograms of benzyl alcohol into the contents of the main mix tank with stirring until a clear solution forms.

The preparation of the nylon fiber shrinking composition is completed by introducing about 32.5 kilograms of calcium nitrate into the contents of the main mix tank with stirring until a clear solution forms.

EXAMPLE II

This mixing procedure is based upon the preparation of 100 kilograms of the nylon fiber shrinking composition. All water is deonized.

Into a main mix tank, introduce about 25.5 kilograms of water, about 15 kilograms of formic acid and about 10 kilograms of lactic acid with stirring.

Introduce about 2 kilograms of 1,3-dimethylurea into the contents of the mix tank with stirring.

Introduce about 7.5 kilograms of 1,2-propanediol into the contents of the mix tank with stirring.

Introduce about 7.5 kilograms of benzyl alcohol into the contents of the main mix tank with stirring until a clear solution forms.

The preparation of the nylon fiber shrinking composition is completed by introducing about 32.5 kilograms of calcium nitrate into the contents of the main mix tank with stirring until a clear solution forms.

The following example demonstrates one method of preparing a print paste composition of this invention.

EXAMPLE III

This mixing procedure is based upon the preparation of about 190 kilograms of the print paste. All water is deonized.

Into a premix tank were introduced about 171.3 kilograms of water, about 5.2 kilograms of thickening agent ("Natrosol 250 HHX") and about 14.3 kilograms of propylene glycol, with stirring at room temperature. The resulting composition was recovered as a print paste stock thickener and found to have a viscosity of 90,000 cps as measured by a Brookfield Viscometer Model RVF, #7 spindle, 20 rpm.

Into a main mix tank were introduced about 4.1 kilograms of water, about 19.1 kilograms of formic acid, about 19.1 kilograms of lactic acid and about 9.6 kilograms of glycolic acid with stirring at room temperature.

About 3.6 kilograms of 1,3-dimethylurea were introduced into the contents of the main mix tank with stirring.

About 14.1 kilograms of 1,2-propanediol were introduced into the contents of the main mix tank with stirring.

About 14.1 kilograms of benzyl alcohol were introduced into the contents of the main mix tank with stirring, and stirring was continued until a clear solution formed.

About 61.8 kilograms of calcium nitrate were introduced into the contents of the main mix tank with stirring until a clear solution formed.

About 43.6 kilograms of the above premixed print paste stock thickener were introduced into the contents of the main mix tank with stirring.

The preparation of the print paste was completed by introducing about 286 grams of Resolin Yellow PPG disperse dye (Color Index No. DY74), about 143 grams of Latyl Cerise YLN disperse dye (Color Index No. DR55) and about 38 grams of Resolin Blue FBL disperse dye (Color Index No. DB56) into the main mix tank to bring the volume of solution to about 190 kilograms.

The resulting solution was recovered as a print paste of this invention suitable for use to print emboss nylon pile fabric.

The print paste was tested and found to have a viscosity of 2000±200 cps as measured by a Brookfield Viscometer Model RVF, #4 spindle, 20 rpm. The paste was found to possess viscosity stability as indicated by a shelf life in excess of 72 hours.

The following example demonstrates the preparation of a print-embossed nylon 66 pile fabric.

EXAMPLE IV

A piece of undyed nylon 66 carpeting (13.0 oz./sq. yd. pile weight, 7/32" pile height, 5/64" gauge, level loop construction) was flat screen printed with a pattern using the print paste composition of Example III.

The print paste was allowed to penetrate the carpeting and the printed carpeting was horizontally steamed using saturated steam at 100° C. for a period of about 8 minutes.

The steamed carpet was then conventionally water washed to remove the printing paste composition and oven dried.

The resulting carpeting was recovered from the oven and observed to possess printing in register with embossing. The dye in the embossed regions of the carpeting was tested according to AATCC 16-E-1964 for lightfastness and found to achieve a value of 4–5 after 80 hours of testing. The embossing or shrinking depth was measured and found to be about 50% of the pile height.

The resulting embossed nylon carpeting was tested and found to exhibit substantially the same wear properties in the embossed areas as in the non-embossed areas. This wear testing served to show that the nylon fiber shrinking composition of this invention does not damage the integrity of the nylon fibers as the result of shrinking.

The above data indicate that the nylon fiber shrinking composition of this invention facilitates the production of print pastes which possess excellent shelf life and the production of print-embossed patterned carpet exhibiting good lightfastness in the print-embossed regions.

It will be evident from the foregoing that various modifications can be made to this invention. Such, however, are considered to be within the scope of the invention.

What is claimed is:

1. An aqueous-based nylon fiber shrinking composition comprising in weight percent from about 5 to about 50 percent calcium nitrate; from about 5 to about 20 percent benzyl alcohol; from about 2.5 to about 15 percent of a polyhydric alcohol or any oxy derivative of a polyhydric alcohol; from about 1 to about 10 percent of a urea compound selected from the group consisting of urea, thiourea, and 1,3-dimethylurea and at least one carboxylic acid selected from the group consisting of formic, acetic, propionic, butyric, oxalic, malonic, glutaric, maleic, glycolic, lactic, glyceric, malic, tartaric and citric; said carboxylic acid being employed in a total amount of from about 5 to about 45 percent.

2. The aqueous-based nylon fiber shrinking composition of claim 1 in which said polyhydric alcohol or an oxy derivative of a polyhydric alcohol is propanediol.

3. The aqueous-based nylon fiber shrinking composition of claim 1 in which said urea compound is 1,3-dimethylurea.

4. An aqueous-based nylon fiber shrinking composition comprising, in weight percent, from about 5 to about 50 percent calcium nitrate, from about 5 to about 20 percent benzyl alcohol, from about 2.5 to about 15 percent propanediol, from about 1 to about 10 percent 1,3-dimethylurea, formic acid, and lactic acid, said formic acid and lactic acid being employed in a total amount of from about 5 to about 45 percent.

5. An aqueous-based nylon fiber shrinking composition comprising, in weight percent, from about 5 to about 50 percent calcium nitrate, from about 5 to about 20 percent benzyl alcohol, from about 2.5 to about 15 percent propanediol, from about 1 to about 10 percent 1,3-dimethylurea, formic acid, lactic acid and glycolic acid, said formic acid, lactic acid and glycolic acid being employed in a total amount of from about 5 to about 45 percent.

6. A print paste composition comprising:

(a) an effective amount of an aqueous-based nylon fiber shrinking composition comprising, in weight percent, from about 5 to about 50 percent calcium nitrate, from about 5 to about 20 percent benzyl alcohol, from about 2.5 to about 15 percent of a polyhydric alcohol or any oxy derivative of a polyhydric alcohol; from about 1 to about 10 percent of a urea compound selected from the group consisting of urea, thiourea and 1,3-dimethylurea; at least one carboxylic acid selected from the group consisting of formic, acetic, propionic, butyric, oxalic, malonic, glutaric, maleic, glycolic, lactic, glyceric, malic, tartaric and citric, said carboxylic acid being employed in a total amount of from about 5 to about 45 percent;

(b) a dye and, (c) a thickening agent.

7. The print paste composition of claim 6 in which said thickening agent is hydroxyethyl cellulose gum.

8. A method for shrinking nylon pile fabric which comprises penetrating a portion of the nylon pile fabric with an aqueous-based nylon fiber shrinking composition comprising, in weight percent, from about 5 to about 50 percent calcium nitrate; from about 5 to about 20 percent benzyl alcohol; from about 2.5 to about 15 percent of a polyhydric alcohol or an oxy derivative of a polyhydric alcohol; from about 1 to about 10 percent of a urea compound selected from the group consisting of urea, thiourea and 1,3-dimethylurea; and, at least one carboxylic acid selected from the group consisting of formic, acetic, propionic, butyric, oxalic, malonic, glutaric, maleic, glycolic, lactic, glyceric, malic, tartaric and citric, said carboxylic acid being employed in a total amount of from about 5 to about 45 percent.

9. A method for producing nylon pile fabric having printed shrunken areas which comprises penetrating a portion of the nylon pile fabric with a print paste composition comprising:

(a) an effective amount of an aqueous-based fiber shrinking composition comprising, in weight percent, from about 5 to about 50 percent calcium nitrate; from about 5 to about 20 percent benzyl alcohol; from about 2.5 to about 15 percent of a polyhydric alcohol or any oxy derivative of a polyhydric alcohol; from about 1 to about 10 percent of a urea compound selected from the group consisting of urea, thiourea and 1,3-dimethylurea; and at least one carboxylic acid selected from the group consisting of formic, acetic, propionic, butyric, oxalic, malonic, glutaric, maleic, glycolic, lactic, glyceric, malic, tartaric and citric, said carboxylic acid being employed in a total amount of from about 5 to about 45 percent;

(b) a dye; and, (c) a thickening agent.

* * * * *